US006227408B1

(12) United States Patent
Poulton

(10) Patent No.: US 6,227,408 B1
(45) Date of Patent: May 8, 2001

(54) METHOD AND APPARATUS FOR DISCHARGING BAGS

(75) Inventor: Barrie Armstrong Poulton, Cheltenham (GB)

(73) Assignee: Flomat Bagfilla International Limited, Derbyshire (GB)

( * ) Notice: Subject to any disclaimer, the term of this patent is extended or adjusted under 35 U.S.C. 154(b) by 0 days.

(21) Appl. No.: 09/396,910

(22) Filed: Sep. 15, 1999

(30) Foreign Application Priority Data

Sep. 26, 1998 (GB) ..... 9820869

(51) Int. Cl.[7] ..... B67B 7/00; B65D 35/56; B67D 5/06

(52) U.S. Cl. ..... 222/1; 222/105; 222/181.2

(58) Field of Search ..... 414/304; 222/1, 222/105, 181.2, 181.3

(56) References Cited

U.S. PATENT DOCUMENTS

| | | | | |
|---|---|---|---|---|
| 4,213,543 | * | 7/1980 | Thiem | 222/105 |
| 4,806,058 | * | 2/1989 | Galichowski et al. | 414/304 |
| 5,507,602 | | 4/1996 | Walker | 406/122 |
| 5,535,791 | | 7/1996 | Lisec | 141/113 |
| 5,682,929 | | 11/1997 | Maginot et al. | 141/65 |
| 5,692,868 | | 12/1997 | Riemersma | 414/403 |
| 5,833,120 | * | 11/1998 | Evens, Sr. et al. | 222/105 |

* cited by examiner

*Primary Examiner*—Kevin Shaver
*Assistant Examiner*—D A Bonderer
(74) *Attorney, Agent, or Firm*—Baker Botts L.L.P.

(57) ABSTRACT

There is disclosed a method for discharging bags in which a full bag with an outlet is supported outlet lowermost over a hopper via which its contents are discharged with the outlet secured to the hopper inlet, and the emptied bag is evacuated via the hopper and collapsed before the outlet is removed from the hopper inlet.

13 Claims, 1 Drawing Sheet

METHOD AND APPARATUS FOR DISCHARGING BAGS

This invention relates to methods and apparatus for discharging bags, especially so-called "big bags" or flexible industrial bulk containers ("FIBC's") used for particulate or powdery materials.

Particularly in the food and pharmaceutical industries it is required to tie off the emptied bag in a collapsed condition before removing it from a discharging station for disposal. Problems are, however, experienced with dust escaping into the environment.

The present invention provides methods and apparatus which address this problem.

The invention, in one aspect, comprises a method for discharging bags in which a full bag with an outlet is supported outlet lowermost over a hopper via which its contents are discharged with the outlet secured to the hopper inlet, and the emptied bag is evacuated via the hopper and collapsed before the outlet is removed from the hopper inlet.

The outlet may be secured in sealing relationship to the hopper inlet and the hopper evacuated to evacuate the emptied bag.

The bag may be collapsed with the aid of external mechanical pressure, which may be applied by moving arm means.

Big bags or FIBC's usually have base supporting loop means by which the bag may be supported base uppermost from hook means of a rigging frame of discharging equipment. These loop means, held apart during discharging, may be moved together during collapsing.

After evacuation and collapsing, the outlet can be safely removed from the hopper inlet and tied off.

The invention also comprises bag discharging apparatus for bags having a discharge outlet, the apparatus comprising a discharge hopper to the inlet of which the outlet can be secured for discharging via the hopper, and bag collapsing means for evacuating the emptied bag via the hopper and collapsing the bag.

The collapsing means many comprise vacuum means evacuating the hopper, and may comprise a duct opening into a side wall of the hopper and being upwardly inclined away from the hopper whereby to avoid ingress of discharging bag contents into the duct.

The bag collapsing means may comprise external mechanical pressure applying means, which may comprise moving arm means, which may comprise arms pivoted about horizontal axes and arranged for initial contact with a supported, emptied bag at its lower, discharge end and progressive upward movement to urge the bag sides together. The arms may be tipped with rollers. The mechanical pressure applying means may be fluid pressure operated.

A rigging frame of the apparatus may have upper hook means for receiving the loops of big bags, said loops being movable together in pairs as the bag collapses.

A method and apparatus for discharging bags according to the invention will now be described with reference to the accompanying drawings, in which.

Figure 1:
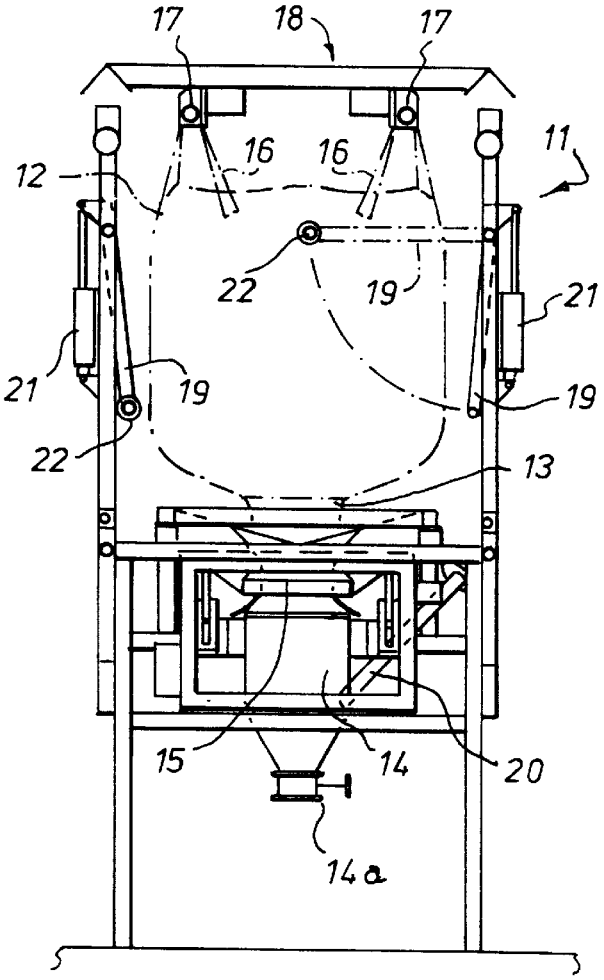
FIG. 1 is an elevation of bag discharging apparatus.

The drawings illustrate bag discharging apparatus 11 for bags 12 having a discharge outlet or spout 13, the apparatus 11 comprising a discharge hopper 14 to the inlet 15 of which the outlet or spout 13 is secured for discharging the bag 12 via the hopper 14.

Such equipment is well known and usually comprises a clamp arrangement at the inlet 15 for securing the spout 13, the spout being at this time tied off so the contents do not flow out when the bag 12 is held by loops 16 on hooks 17 of a rigging frame 18—hoisted there, for example, by a fork-lift truck. Once in place and its spout 13 clamped to the inlet 15, the bag tie is released so the contents can fall into the hopper 14, a vibrator arrangement often being provided to help discharge. The contents are held back by a lower valve 14*a* of the hopper to be dispensed therethrough as may be required.

The hopper 14 has a duct 20 opening into a side wall to which a source of vacuum can be attached. When the bag contents have been completely discharged via the hopper 14, the lower valve 14*a* is closed and the hopper 14—and hence the bag 12 evacuated through the duct 20. The duct is upwardly inclined away from the hopper 14 to avoid bag contents getting in and blocking it.

In addition, external mechanical pressure is brought to bear on the sides of the bag 12 by horizontally pivoted arms 19 operated by fluid pressure cylinders 21 to move from their rest position (solid line) progressively upwardly, first contacting through tip-carried rollers 22—the lower (spout) end of the bag 12 and moving up to the uppermost (base) end of the bag. This mechanical pressure can be applied during evacuation to assist in the orderly collapse of the bag 12.

Figure 2:
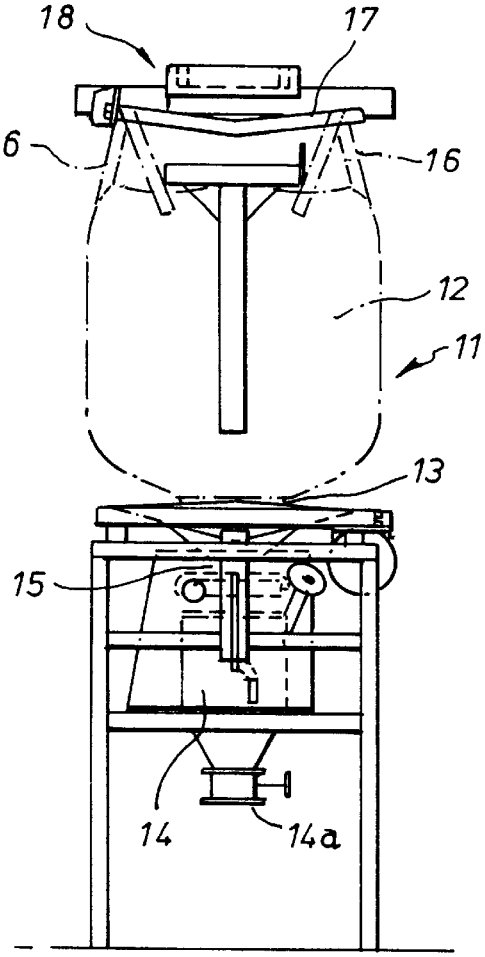
FIG. 2 is a view on Arrow 2 of FIG. 1.
Figure 3:
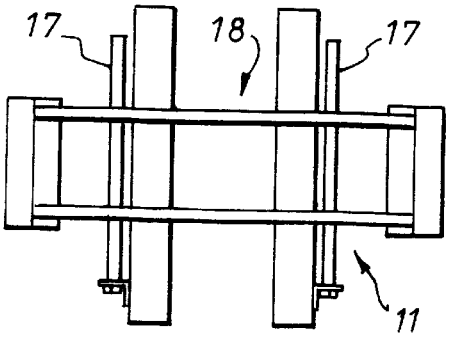
FIG. 3 is a plan view of FIG. 1.
Figure 4:
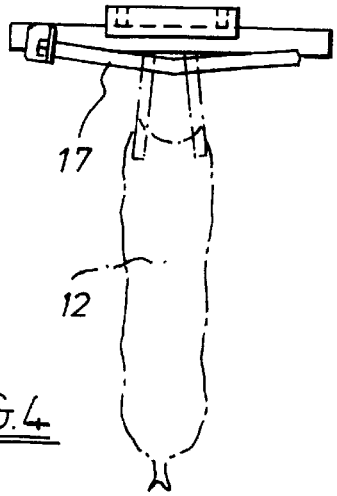
FIG. 4 shows a collapsed bag prior to removal from the apparatus.

The hooks 17 are of shallow V-shaped (see FIGS. 2 and 4) which enable the loops 16 (of which there are four, one at each corner of the bag 12) to come together in pairs during collapsing by sliding down the limbs of the V-shaped hooks.

After evacuation and collapse, the bag 12 can be tied off, unclamped from the hopper inlet 15 and taken down off the rigging frame.

Clearly, different embodiments of equipment may be provided for dealing with different shapes and sizes of bag in different circumstances, to ensure that the bag is evacuated and collapsed before being tied off prior to removal.

Thus, for example, the external mechanical pressure may be applied by other means such as by arms or plates lying in a vertical plane which move horizontally towards one another from opposite sides of the bag.

What is claimed is:

1. A method for discharging a bag in which a full bag provided at one end with pairs of suspension loops and at the other end with an outlet is suspended by said pairs of loops with its outlet lowermost over a hopper via which its contents are discharged with the outlet secured to the hopper inlet, and the emptied bag is collapsed with the aid of inwardly directed external mechanical pressure applied to opposite sides of the bag before the outlet is removed from the hopper inlet, the pairs of loops being engaged with oppositely sloping surfaces so arranged that the pairs of loops remain apart during bag discharge but move downwardly along said sloping surfaces and together in pairs as the applied external mechanical pressure collapses the bag.

2. A method as claimed in claim 1 in which the mechanical pressure is applied in a direction transverse to said sloping surfaces.

3. A method according to claim 1, in which the outlet is secured in sealing relationship to the hopper inlet and the emptied bag is evacuated by applying a vacuum to the hopper.

4. A method according to claim 1, in which the outlet is tied off on removal from the hopper inlet.

5. Bag discharging apparatus for bags having pairs of suspension loops at one end and a discharge outlet at the opposite end, the apparatus comprising a discharge hopper to the inlet of which the outlet can be secured for discharging via the hopper, oppositely sloping loop suspension surfaces located above the hopper for engagement by said pairs of loops to suspend the bag with its outlet lowermost over the hopper, and inwardly directed mechanical pressure applying means for engagement with opposite sides of the suspended bag to effect collapsing of the bag after it has been emptied but whilst its outlet is still secured for discharge via the hopper, said external pressure applying means acting in a direction transverse to the direction of slope of said sloping surfaces whereby collapsing of the emptied bag is accompanied by movement of said pairs of loops downwardly along said sloping surfaces and together in pairs.

6. Apparatus according to claim 5, which the bag collapsing means comprise vacuum means evacuating the hopper.

7. Bag discharging apparatus for bags having a discharge outlet, the apparatus comprising a discharge hopper to the inlet of which the outlet can be secured for discharging via the hopper, and means for collapsing the bag after it has been emptied but whilst its outlet is still secured for discharge via the hopper, the bag collapsing means including vacuum means evacuating the hopper, in which the vacuum means comprise a duct opening into a side wall of the hopper and being upwardly inclined away from the hopper whereby to avoid ingress of discharging bag contents into the duct.

8. Apparatus according to claim 7, in which the bag collapsing means comprises external mechanical pressure applying means.

9. Apparatus according to claim 8, in which said pressure applying means comprise moving arm means.

10. Bag discharging apparatus for bags having a discharge outlet, the apparatus comprising a discharge hopper to the inlet of which the outlet can be secured for discharging via the hopper, and means for collapsing the bag after it has been emptied but whilst its outlet is still secured for discharge via the hopper, the bag collapsing means includes moving arms pivoted about horizontal axes and arranged for initial contact with a supported emptied bag at its lower, discharge end and progressive upward movement to urge the bag sides together.

11. Apparatus according to claim 10, in which the arms are tipped with rollers.

12. Apparatus according to any one of claims 8 to 11, in which the mechanical pressure applying means are fluid pressure operated.

13. Apparatus according to any one of claims 7 to 11, comprising upper hook means for receiving the hanging loops of big bags, said hook means being of shallow V-shape to enable the loops to come together in pairs by sliding down the limbs of the V-shaped hooks as the bag collapses.

* * * * *